United States Patent [19]

MacGilp et al.

[11] 4,454,049

[45] Jun. 12, 1984

[54] TEXTILE TREATMENT COMPOSITIONS

[75] Inventors: Neil A. MacGilp, Waterloo, Belgium; Allan C. McRitchie, Tyne and Wear, England; Barry T. Ingram, Tyne and Wear, England; John Hampton, Tyne And Wear, England

[73] Assignee: The Procter & Gamble Company, Cincinnati, Ohio

[21] Appl. No.: 439,974

[22] Filed: Nov. 8, 1982

[30] Foreign Application Priority Data

Nov. 14, 1981 [GB] United Kingdom ..... 8134377

[51] Int. Cl.[3] ..... D06M 13/46; D06M 13/02; D06M 13/20

[52] U.S. Cl. ..... 252/8.8; 252/8.6

[58] Field of Search ..... 252/8.8

[56] References Cited

U.S. PATENT DOCUMENTS

| | | | |
|---|---|---|---|
| 3,395,100 | 7/1968 | Fisher | 252/8.6 |
| 4,149,978 | 4/1979 | Goffinet | 252/8.8 |
| 4,155,855 | 5/1979 | Goffinet et al. | 252/8.8 |
| 4,233,164 | 11/1980 | Davis | 252/8.8 |
| 4,320,013 | 3/1982 | Lohman | 252/8.8 |
| 4,339,045 | 8/1983 | Burns | 252/8.8 |

FOREIGN PATENT DOCUMENTS

| | | |
|---|---|---|
| 18039 | 10/1980 | European Pat. Off. . |
| 59502 | 9/1982 | European Pat. Off. . |
| 1538094 | 1/1979 | United Kingdom . |
| 2007734 | 5/1979 | United Kingdom . |

*Primary Examiner*—Maria Parrish Tungol

*Attorney, Agent, or Firm*—Richard C. Witte; Ronald L. Hemingway

[57] ABSTRACT

Liquid textile treatment compositions in the form of isotropic solutions comprising water-insoluble di-$C_{16}$–$C_{24}$ optionally hydroxy-substituted alkyl, alkaryl or alkenyl cationic fabric softener, at least about 70% of the fabric softener consisting of one or more components together having a melting completion temperature of less than about 20° C., a water-insoluble nonionic extender, especially $C_{10}$–$C_{40}$ hydrocarbons or esters of mono- or polyhydric alcohols with $C_8$–$C_{24}$ fatty acids, and a water-miscible organic solvent. The concentrates have improved formulation stability and dispersibility combined with excellent fabric softening characteristics.

8 Claims, No Drawings

TEXTILE TREATMENT COMPOSITIONS

TECHNICAL FIELD

This invention relates to textile treatment compositions. More particularly it relates to textile treatment compositions in concentrated form suitable for use in the rinse cycle of a textile laundering operation to provide fabric softening/static control benefits, the compositions being characterized by excellent softening, water dispersibility and storage properties after prolonged storage at both elevated and sub-normal temperatures.

BACKGROUND

Textile treatment compositions suitable for providing fabric softening and static control benefits during laundering are well known in the art and have found widespread commercial application. Conventionally, rinse-added fabric softening compositions contain, as the active component, substantially water-insoluble cationic materials having two long alkyl chains. Typical of such materials are di-hardened tallow dimethylammonium chloride and imidazolinium compounds substituted with two hardened tallow groups. These materials are normally prepared in the form of a dispersion in water and it is generally not possible to prepare such aqueous dispersions with more than about 6% of cationic softener without encountering severe product viscosity and storage-stability problems. Although more concentrated dispersions of softener material can be prepared as described in European Patent Application No. 406 and Bri. Pat. No. 1,601,360 by incorporating certain nonionic adjunct softening materials therein, such compositions tend to be relatively inefficient in terms of softening benefit/unit weight of active; moreover, product viscosity and stability problems become increasingly unmanageable in more concentrated aqueous dispersions and effectively limit the commercial range of applicability to softener active levels in the range from about 15% to about 20%.

Cationic softener materials are normally supplied by the manufacturer in the form of a slurry containing about 70%–80% of active material in an organic liquid such as isopropanol sometimes containing a minor amount of water (up to about 10%). Retail fabric softening compositions are then prepared by dispersion of the softener slurry in warm water under carefully controlled conditions. The physical form and dispersibility constraints of these industrial concentrates, however, are such as to preclude their direct use by the domestic consumer; indeed, they can pose severe processing problems even for the industrial supplier of retail fabric softening compositions.

In United Kingdom Application No. 2,007,734A, fabric softener concentrates are disclosed containing a mixture of a fatty quaternary ammonium salt having at least one $C_8$–$C_{30}$ alkyl substituent and an oil or substantially water-insoluble compound having oily/fatty properties. The concentrates are said to be easily dispersed/emulsified in cold water to form fabric softening compositions of adequate viscosity, thereby facilitating softener production by a manufacturer without the need for special mixing equipment. Applicants have found, however, that although these concentrates go some way towards alleviating the problems of the industrial manufacturer, the compositions are still highly deficient from the viewpoint of providing acceptable cold-water dispersibility, formulation stability at both elevated and sub-normal temperatures, together with satisfactory softening performance. As a result, the prior art compositions are essentially of limited value as retail compositions for direct use by the domestic consumer.

The present invention therefore provides a concentrated liquid textile treatment composition having improved stability at both elevated and sub-normal temperatures under prolonged storage conditions and good cold-water dispersibility in the dispenser of a domestic automatic washing machine together with excellent softening, anti-static and fabric rewettability characteristics across a broad range of fabric types.

SUMMARY OF THE INVENTION

Accordingly, the present invention provides a liquid fabric softener concentrate characterized by (a) from about 15% to about 80%, preferably from about 20% to about 75% of substantially water-insoluble di-$C_{16}$–$C_{24}$ optionally hydroxy-substituted alkyl, alkaryl or alkenyl cationic fabric softener, at least about 70% of said fabric softener consisting of one or more components together having a melting completion temperature ($T_c$) of less than about 20° C., (b) from about 0.5% to about 80%, preferably from about 3% to about 70% of substantially water-insoluble nonionic extender selected from $C_{10}$–$C_{40}$ hydrocarbons and $C_8$–$C_{24}$ fatty acid esters, and (c) from about 5% to about 84.5%, preferably from about 10% to about 77% of water-miscible organic solvent, wherein the cationic fabric softener, nonionic extender and organic solvent constitute in total at least about 50% of the concentrate.

The nonionic extender is thus selected from $C_{10}$–$C_{40}$, especially $C_{12}$–$C_{24}$ linear or branched hydrocarbons, and esters, especially the complete esters, of mono- or polyhydric alcohols with $C_8$–$C_{24}$, especially $C_{12}$–$C_{22}$ fatty acids. Highly preferred are $C_{12}$–$C_{24}$ linear or branched non cyclic hydrocarbons and complete esters of glycerol with $C_{12}$–$C_{22}$ fatty acids. In physical terms, the nonionic extender preferably has a hydrophilic-lipophilic balance (HLB) of less than about 1.5, more preferably less than about 1.

Suitable cationic softeners herein can be defined according to their solid-liquid melting transition characteristics. It will be appreciated that typical commercial softeners generally consist of a complex mixture of materials for which "melting point" as such becomes a poorly defined parameter. In the present development, therefore, the solid-liquid melting transition is monitored by thermal analysis using a differential scanning calorimeter (DSC) and the transition characterized by its "melting completion temperature". On this basis, the cationic softener herein is such that at least 70%, preferably at least 85%, more preferably at least 95% of the softener consists of one or more components together having a melting completion temperature of less than about 20° C., preferably from about 0° C. to about 17° C., more preferably from about 3° C. to about 16° C. In preferred embodiments, at least about 60%, preferably at least about 70% of the cationic softener consists of one or more components together having a melting completion temperature or less than about 12° C. Moreover, in highly preferred embodiments, the cationic softener consists substantially completely of one or more components together having a melting completion temperature of less than about 20° C., preferably less than about 16° C.

The cationic softener component of the present compositions is preferably also characterized in terms of Krafft temperature, ie the temperature at which a 10% by weight softener/distilled water system begins to undergo its solid-mesomorphic liquid transition. The cationic softeners suitable herein are preferably such that at least 70%, more preferably at least 85% especially at least 95% thereof consists of one or more components together having a Krafft temperature of less than about 10° C.

Highly preferred cationic softeners are monoammonium, polyammonium or imidazolinium materials having two $C_{16}$–$C_{24}$ at least partly unsaturated substituents, ie, alkenyl or mixed alkyl/alkenyl substituents. The degree of unsaturation of such materials can be described, as usual, in terms of iodine value (grams of iodine absorbed/100 grams of unsaturated material). Preferably, cationic softeners suitable herein have an iodine value greater than about 20, more preferably greater than about 30, for example unhardened tallowalkyl derivatives; also suitable are cationic softeners having an iodine value of greater than about 45, more preferably greater than about 55, for example oleyl alkyl derivatives.

The organic solvent component of the present compositions acts as a solvent both for the cationic softener and for the nonionic extender and is also water-miscible. Preferred organic solvents have a dielectric constant at 20° C. of at least about 13, preferably at least about 17. The solvent is normally present at levels in excess of about 2%.

In physical terms, the present concentrates generally exist in the form of homogeneous, isotropic solutions of water-insoluble softener material in organic solvent, the solutions being homogeneous and isotropic in the sense of being microscopically single phase as well as microscopically randomly orientated under polarized light (at 100× magnification).

A valuable and unanticipated benefit of the present invention is that concentrates can be prepared as homogeneous, isotropic stable solutions even in admixture with substantial levels of water—up to 50% in suitable instances. Preferably, water, if present, is added at a weight ratio of water:organic solvent of less than about 3.5:1, more preferably less than 3:1, especially less than 2.5:1. Also the water:nonionic extender ratio is preferably less than about 3:1, especially less than about 2:1. Preferred compositions of this type contain from about 15% to 45% water, more preferably from about 20% to 35% water.

Stable concentrates can be prepared according to the invention across a wide range of component levels. Thus, softener concentrates can be formulated delivering softening performance equivalent to that of a conventional (about 6%) aqueous fabric softener at either a small or large sub-multiple of current softener usage. In this respect the denominator (n) of the sub-multiple characterizes the concentrate as being of the nth degree of concentration.

Preferred compositions having a relatively low degree of concentration (n being from about 3 to about 6) contain from about 20% to about 44% of cationic fabric softener, from about 3% to about 70% of nonionic extender, from about 10% to about 77% of organic solvent and from 0% to about 45%, preferably from about 15% to about 45%, of water with the cationic fabric softener, nonionic extender and organic solvent consituting in total at least about 55% of the concentrate. Preferred compositions having a relatively high degree of concentration (n being from about 7 to about 10), on the other hand, contain from about 45% to about 75% of cationic fabric softener, from about 3% to about 45% of nonionic extender, from about 10% to about 52% of organic solvent and from 0% to about 30%, preferably from 0% to about 15% of water, with the cationic fabric softener, nonionic extender and organic solvent constituting in total at least about 70% , preferably at least about 85%, of the concentrate.

As discussed earlier, the concentrates of the invention can contain significant levels of water, especially in those compositions having lower degrees of concentrations. Thus, according to a second aspect of the invention, there is provided a liquid fabric softener concentrate characterized by an isotropic solution of substantially water-insoluble di-$C_{16}$–$C_{24}$ optionally hydroxy-substituted alkyl, alkaryl, or alkenyl cationic fabric softener, at least about 70% of said fabric softener consisting of one or more components together having a melting completion temperature ($T_c$) of less than about 20° C., in a solvent system comprising at least about 5% of water-miscible organic solvent and from about 15% to 45% of water. The weight ratio of water:organic solvent is preferably less than about 3.5:1.

Preferred compositions of this type contain from about 15% to about 80% cationic softener, and from 0% to about 65%, preferably from about 3% to about 65% of nonionic extender as described earlier, with the cationic softener, organic solvent and nonionic extender, if present, together constituting at least about 55% of the concentrate.

A further unexpected benefit of the softener concentrates is the ability to incorporate therein minor levels of cationic softener materials which otherwise would be unstable in softener concentrates, even in the presence of nonionic extenders. Such materials generally have a melting completion temperature in excess of 25° C. and even as much as 50° C. or higher. High melting softeners of this type are often highly effective materials from a softening performance viewpoint; unfortunately, however, their physical characteristics have generally precluded their use in highly concentrated softener compositions for domestic use.

In highly preferred embodiments, the organic solvent component of the softener concentrate comprises hexylene glycol, preferably in an amount of at least 9%, more preferably at least 15% of composition. Combinations of hexylene glycol and other solvents such as isopropanol, ethanol, propylene glycol or diethyleneglycol are also suitable, mixed solvents preferably containing at least about 50%, more preferably at least about 75% of hexyleneglycol. These compositions are highly suitable from the viewpoint of minimizing product residues in the washing machine product dispenser, particularly when the dispenser has been prewetted prior to adding the concentrate. Thus according to a further aspect of the invention, there is provided a liquid fabric softener concentrate characterized by an isotropic solution of substantially water-insoluble di-$C_{16}$–$C_{24}$, optionally hydroxy substituted alkyl, alkaryl or alkenyl cationic fabric softener, at least 70% of said fabric softener consisting of one or more components together having a melting completion temperature ($T_c$) of less than 20° C., in a solvent system comprising hexylene glycol.

Another valuable feature of the present invention is that softener concentrates of excellent stability can be achieved without resorting to use therein of water-soluble cationic or nonionic surfactants as stabilizing agents. The importance of this is that water-soluble cationic and nonionic surfactants can have a significant deleterious effect on the softening performance of aqueous softener compositions; achieving stability in the absence of micelle-forming water-soluble surfactant is therefore a valuable advantage.

Accordingly, the level of water-soluble surfactant in composition is preferably such as to provide a surface tension at 0.03 g/liter in distilled water of at least 55, more preferably at least 60 dyne/cm at 20° C. (Du Nouy Tensiometer).

The individual components of the softener concentrate will now be discussed in detail.

The cationic softener is a substantially water-insoluble di-$C_{16}$–$C_{24}$ optionally hydroxy-substituted alkyl, alkaryl or alkenyl material, the major proportion of which consists of one or more components together having a defined melting completion temperature ($T_c$), namely $T_c < 20°$ C.

Melting completion temperatures are determined herein by thermal analysis using a Du Pont 910 Differential Scanning Calorimeter with Mechanical Cooling Accessory and R90 Thermal Analyser as follows. A 5–10 mg sample of the softener material having a bound moisture content of 2%–5% and containing no free water or solvent, is encapsulated in a hermetically sealed pan with an empty pan as reference. The sample is initially heated until molten and then rapidly cooled (at about 20°–30° C./min) to −70° C. Thermal analysis is then carried out at a heating rate of 10° C./min using sufficient amplification of T signal (ie temperature difference between sample and reference—vertical axis) to obtain an endotherm-peak signal:baseline noise ratio of better than 10:1. The melting completion temperature is then the temperature corresponding to the intersection of the tangential line at the steepest part of the endotherm curve at the high temperature end of the endotherm, with the horizontal line, parallel to the sample temperature axis, through the highest temperature endotherm peak.

In structural terms, the preferred cationic softeners are selected from the following:

(a) ammonium compounds of formula I

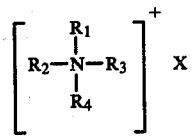

I wherein $R_1$ and $R_2$ independently represent linear or branched chain alkyl and/or alkenyl groups of from 16 to 24 carbon atoms, $R_3$ and $R_4$ independently represent hydrogen or alkyl or alkenyl groups of from 1 to 4 carbon atoms, and X is a salt counterion, wherein the quaternary ammonium compound has an iodine value greater than 40, preferably greater than 55.

(b) alkoxylated ammonium compounds of formula II

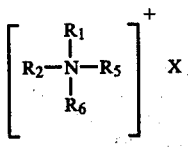

II wherein $R_1$ and $R_2$ independently represent linear or branched chain alkyl and/or alkenyl groups of from 16 to 24 carbon atoms, $R_5$ and $R_6$ independently represent alkyl, or alkenyl groups of from 1 to 4 carbon atoms or a group of formula $(C_nH_{2n}O)_mH$ wherein n is 2 or 3 and m is from 0 to 15, provided that the total number of $C_nH_{2n}O$ groups is from 1 to 20 and wherein the alkoxylated ammonium compound has an iodine value greater than 20, preferably greater than 30, and (c) imidazolinium compounds of formula III

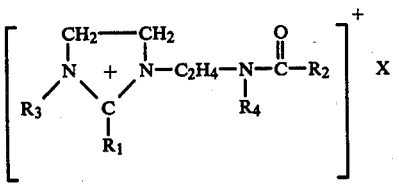

III wherein $R_1$ and $R_2$ independently represent linear or branched chain alkyl and/or alkenyl groups of from 16 to 24 carbon atoms, $R_3$ and $R_4$ independently represent hydrogen, alkyl, alkenyl or hydroxyalkyl groups of from 1 to 4 carbon atoms, and X is a salt counterion, wherein the imidazolinium compound has an iodine value greater than 40, preferably greater than 55.

Of the above, preferred are compounds of formula I in which $R_1$ and $R_2$ are selected from palmitoleyl, oleyl, soyayl 12-hydroxy-9:10-octadecenoyl, 9:10-eicosenoyl, 11:12-docosenoyl, 13:14-docosenoyl, and 15:16-tetracosenoyl, and $R_3$, $R_4$ are methyl; compounds of formula II in which $R_1$ and $R_2$ are as defined for formula I or alternatively are unhardened tallow alkyl, $R_5$, $R_6$ are independently methyl, hydroxyethyl or hydroxypropyl; and compounds of formula III in which $R_1$ and $R_2$ are as defined for formula I and $R_3$, $R_4$ are independently methyl, hydroxyethyl or hydroxypropyl. Highly preferred are compounds of formula II in which $R_1$, $R_2$ are both soft tallowalkyl, $R_5$ is methyl and $R_6$ is hydroxypropyl; and compounds of formula III in which $R_1$, $R_2$ are both oleyl. Binary and ternary mixtures of I, II and III are also envisaged, especially mixtures of II and III.

As explained earlier, the Krafft temperature of the cationic softener is also of importance from the viewpoint of achieving optimum dispersibility in cold water. Krafft temperature can be obtained by thermal analysis of mixed softener/water systems and is designated herein as the sample temperature at the point of intersection of the base line with a tangent to the steepest part of the endotherm nearest the low temperature end of the endotherm. Preferred softener materials herein have a Krafft temperature of less than about 10° C., more preferably less than about 5° C.

The nonionic extender component of the present compositions is preferably selected from $C_{10}$–$C_{40}$ linear or branched hydrocarbons and esters of mono- or polyhydric alcohols with $C_8$–$C_{24}$ fatty acids.

Preferably, hydrocarbons useful in the present invention are linear or branched paraffins or olefins especially those that are non-cyclic in character. Materials known generally as paraffin oil, soft paraffin wax and petrolatum are especially suitable. Particularly suitable are paraffin oils derived from mineral sources such as petroleum. Examples of specific materials are tetradecane, hexadecane, octadecene and octadecane. Preferred commercially-available paraffin mixtures include spindle oil, light oil, refined white oils and technical grade mixtures of $C_{14}$ $C_{17}$ and $C_{18}/C_{20}$ n-paraffins.

The second class of nonionic extender is represented by fatty acid esters of mono- or polyhydric alcohols, highly preferred materials of this type being complete esters.

The mono- or polyhydric alcohol portion of the ester can be represented by methanol, isobutanol, 2-ethylhexanol, isopropanol, ethylene glycol, polyethylene glycols, glycerol, diglycerol, xylitol, sucrose, erythritol, pentaerythritol, sorbitol or sorbitan. Ethylene glycol, polyethylene glycol, sorbitan and especially glycerol esters are preferred.

The fatty acid portion of the ester normally comprises a fatty acid having from 8 to 24 carbon atoms, typical examples being lauric acid, myristic acid, palmitic acid, stearic acid, oleic acid and behenic acid.

Highly preferred esters herein are glycerol trioleate, methyl laurate, ethyl stearate, isopropyl myristate, isopropyl palmitate, iso-butyl stearate, isopropylstearate, 2-ethylhexyl laurate and isooctyl myristate. Of the above, glycerol trioleate is highly preferred.

In preferred embodiments, the nonionic extender is liquid at or close to normal temperature, highly suitable materials having a melting completion temperature (DSC) of less than about 25° C., preferably less than about 20° C. The viscosity of the liquid is preferably less than about 25 cp (0.025 Pa.s), more preferably less than about 15 cp (0.015 Pa.s) at 25° C.

Preferred organic solvents in the present compositions are water-miscible, protic solvents, especially mono- or polyhydric alcohols containing from one to ten carbon atoms, for example, ethanol, isopropanol, isobutanol, propylene glycol, propyleneglycol monomethyl or ethyl ether, 1,2-propane diol, 1-pentanol, 1-hexanol, hexylene glycol, glycerol, ethylene glycol, diethyleneglycol and diethyleneglycol monobutyl ether. The highly preferred solvent is hexylene glycol as described above.

Regarding the cationic softener components of melting completion temperature greater than 25° C., these are preferably quaternary ammonium compounds having the formula IV

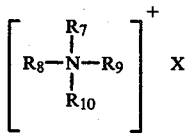

IV wherein $R_7$ and $R_8$ represent alkyl groups of from about 12 to about 24 carbon atoms; $R_9$ and $R_{10}$ represent alkyl, or hydroxyalkyl groups containing from 1 to about 4 carbon atoms; and X is the salt counter-anion, preferably selected from halide, methyl suulfate and ethyl sulfate radicals. Representative examples of these quaternary softeners include di-hydrogenated tallow dimethyl ammonium chloride; di-hydrogenated tallow dimethyl ammonium methyl sulfate; dihexadecyl dimethyl ammonium chloride; distearyl dimethyl ammonium chloride; dieicosyl dimethyl ammonium chloride; didocosyl dimethyl ammonium chloride; and dihexadecyl diethyl ammonium chloride. Of these, di (hydrogenated tallow alkyl) dimethyl ammonium chloride is preferred.

Another suitable class of water-insoluble high melting cationic materials are the alkyl imidazolinium salts believed to have the formula:

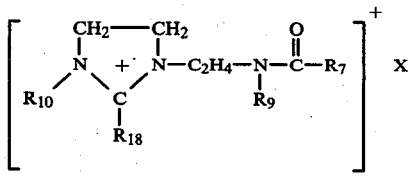

wherein $R_7$ is an alkyl containing from 12 to 24 carbon atoms, $R_8$ is an alkyl containing from 12 to 24 carbon atoms, and $R_9$, $R_{10}$ are alkyl or hydroxyalkyl containing from 1 to 4 carbon atoms and X is the salt couter-anion, preferably a halide, methosulfate or ethosulfate. A preferred imidazolinium salt is 3-methyl-1-(hydrogenated tallowamido) ethyl -2-hydrogenated tallowyl-dihydroimidazolinium methosulfate.

The compositions herein can optionally contain other ingredients known to be suitable for use in textile softeners. Such adjuvants include perfumes, preservatives, germicides, colorants, dyes, fungicides, stabilizers, brighteners and opacifiers. These adjuvants, if used, are normally added at their conventional levels. However, in the case of composition ingredients utilized for a fabric treatment effect, eg perfumes, these materials can be added at higher than normal levels, corresponding to the degree of concentration of the product. In addition, the compositions of the invention, for stability purposes, also preferably contain no more than about 200 ppm of alkali metal cations.

The following examples illustrate the invention. In the Examples, the following abbreviations have been used:

Di unhardened tallow hydroxypropylmethyl ammonium chloride ($T_c$=14° C.) DTHMAC Di hydrogenated tallow dimethyl ammonium chloride ($T_c$=65° C.) DTDMAC 3-methyl-1-(2-oleylamido)ethyl-2-oleyl-imidazolinium methosulphate ($T_c$=5° C.) DOMI 3-methyl-1-(2-hydrogenated tallowylamido) ethyl-2-hydrogenated tallowyl-imidazolinium methosulphate ($T_c$=59° C.) DTMI 3-methyl-1-(2-unhardened tallowylamido)ethyl-2-unhardened tallowyl-imidazolinium methosulfate ($T_c$=38° C.) DUTMI

EXAMPLES I TO VII

The following concentrated textile treatment compositions are prepared by mixing all ingredients together at a temperature of 40° C.

| | Examples | | | | | | |
|---|---|---|---|---|---|---|---|
| | I | II | III | IV | V | VI | VII |
| DTHMAC | — | 50 | 50 | — | 30 | 27 | 50 |
| DOMI | 62 | — | — | 45 | — | — | — |
| $C_{14}$–$C_{17}$ n-paraffins | 10 | — | — | — | — | — | — |
| $C_{18}$–$C_{20}$ n-paraffins | — | — | — | 10 | — | — | — |
| $C_{20}$–$C_{24}$ branched paraffins (Witco Carnation oil) | — | — | 10 | — | 10 | 53 | 25 |
| Glyceryl trioleate | — | 25 | — | — | — | — | — |
| Isopropyl alcohol | 20 | — | 10 | 5 | 6 | — | — |

-continued

| | Examples | | | | | | |
|---|---|---|---|---|---|---|---|
| | I | II | III | IV | V | VI | VII |
| Hexylene glycol | — | 24 | 18 | 37 | 47 | 18 | — |
| Propylene glycol | — | — | — | — | — | — | 25 |
| Perfume | 5 | 1 | 4 | 3 | 2 | 1 | — |
| Polystyrene latex opacifier and dye | — | — | 1 | — | 1 | 1 | — |
| Water | 3 | — | 7 | — | 4 | — | — |

The above formulae are concentrated liquid compositions having improved stability at both elevated and sub-normal temperatures under prolonged storage conditions, good cold-water dispersibility via the dispenser of domestic automatic washing machines together with excellent softening, anti-static and fabric rewettability characteristics across a broad range of fabric types.

EXAMPLES VIII to XII

The following compositions are prepared as in Examples I to VII.

| | Examples | | | | |
|---|---|---|---|---|---|
| | VIII | IX | X | XI | XII |
| DTHMAC | 45 | — | 64 | — | 37 |
| DOMI | — | 20 | — | 30 | — |
| $C_{14}$–$C_{17}$ n-paraffins | — | — | — | 14 | — |
| $C_{18}$–$C_{20}$ n-paraffins | — | — | 10 | — | — |
| Carnation oil | 27 | 3 | — | — | 17 |
| Isopropyl alcohol | 6 | — | 7 | — | — |
| Hexylene glycol | — | 27 | — | 15 | 17 |
| Perfume | 3 | — | 3 | 1 | 1 |
| Polystyrene latex opacifier and dye | — | — | 1 | — | 1 |
| Water | 19 | 50 | 15 | 40 | 27 |

The above formulae are concentrated liquid compositions having improved stability at both elevated and sub-normal temperatures under prolonged storage conditions, good cold-water dispersibility via the dispenser of domestic automatic washing machines together with excellent softening, anti-static and fabric rewettability characteristics across a broad range of fabric types.

EXAMPLES XIII TO XVIII

The following compositions are prepared as in Examples I to VII.

| | Examples | | | | |
|---|---|---|---|---|---|
| | XIII | XIV | XV | XVI | XVII |
| DTHMAC | — | 40 | — | 25 | — |
| DOMI | 52 | — | 30 | — | 30 |
| DTDMAC | 16 | — | 10 | 5 | — |
| DTMI | — | — | — | — | 10 |
| DUTMI | — | 10 | — | — | — |
| $C_{14}$–$C_{17}$ n-paraffins | — | — | — | — | 10 |
| $C_{18}$–$C_{20}$ n-paraffins | — | — | 39 | — | — |
| Carnation oil | 10 | — | — | 10 | — |
| Glyceryl trioleate | — | 25 | — | — | — |
| Isopropyl alcohol | 7 | — | 5 | 6 | — |
| Hexylene glycol | 9 | 24 | 10 | 47 | 50 |
| Perfume | 1 | 1 | 2 | 2 | 1 |
| Polystyrene latex opacifier and dye | 1 | — | 1 | 1 | — |
| Water | 4 | — | 3 | 4 | — |

The above formulae are concentrated liquid compositions having improved stability at both elevated and sub-normal temperatures under prolonged storage conditions, good cold-water dispersibility via the dispenser of domestic automatic washing machines together with excellent softening, anti-static and fabric rewettability characteristics across a broad range of fabric types.

What is claimed is:

1. A liquid fabric softener concentrate in the form of an isotropic solution comprising (a) from about 20% to about 75% of substantially water-insoluble cationic fabric softener, at least about 70% of said fabric softener consisting of one or more components together having a melting completion temperature ($T_c$) of less than 20° C.

(b) from about 3% to about 75% of substantially water-insoluble nonionic extender selected from the group consisting of $C_{10}$–$C_{40}$ linear and branched hydrocarbons and esters of mono- and polyhydric alcohols with $C_8$–$C_{24}$ fatty acids, and (c) from about 10% to about 77% of water-miscible organic solvent, wherein the cationic fabric softener, nonionic extender and organic solvent constitute in total at least about 50% of the concentrate and wherein Component (a) is selected from the following compounds or mixtures thereof:

ammonium compounds of formula

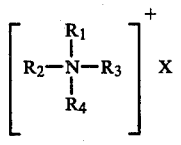

wherein $R_1$ and $R_2$ independently represent linear or branched chain alkyl or alkenyl groups of from about 16 to about 24 carbon atoms, $R_3$ and $R_4$ independently represent hydrogen or alkyl or alkenyl groups of from 1 to about 4 carbon atoms, and X is a salt counterion, wherein the ammonium compound has an iodine value greater than about 40, alkoxylated compounds of formula

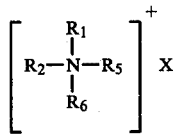

wherein $R_1$ and $R_2$ independently represent linear or branched chain alkyl or alkenyl groups of from about 16 to about 24 carbon atoms, $R_5$ and $R_6$ independently represent alkyl or alkenyl groups of from 1 to about 4 carbon atoms or a group of formula $(C_nH_{2n}O)_mH$ wherein n is 2 or 3 and m is from 0 to about 15, provided that the total number of $C_nH_{2n}O$ groups is from 1 to about 20 and wherein the alkoxylated ammonium compound has an iodine value greater than about 20, imidazolinium compounds of formula

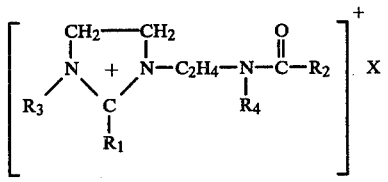

wherein $R_1$ and $R_2$ independently represent linear or branched chain alkyl and/or alkenyl groups of from about 16 to about 24 carbon atoms, $R_3$ and $R_4$ independently represent hydrogen, alkyl, alkenyl or hydroxyalkyl groups of from 1 to about 4 carbon atoms, and X is a salt counterion, wherein the imidazolinium compound has an iodine value greater than about 40.

2. A concentrate according to claim 1 wherein the cationic fabric softener consists substantially completely of one or more components together having a melting completion temperature in the range of from about 0° C. to about 17° C.

3. A concentrate according to claim 3 wherein the cationic fabric softener has a Krafft temperature of less than about 10° C.

4. A concentrate according to claim 1 wherein the nonionic extender is selected from the group consisting of $C_{12}$–$C_{24}$ linear and branched noncyclic hydrocarbons and complete esters of glycerol with $C_{12}$–$C_{24}$ fatty acids.

5. A concentrate according to claim 1 wherein the organic solvent comprises hexylene glycol.

6. A concentrate according to claim 1 wherein the concentrate additionally comprises up to about 50% water in a weight ratio of water:organic solvent of less than about 3.5:1.

7. A concentrate according to claim 1 comprising from about 45% to about 75% of cationic fabric softener, from about 3% to about 45% of nonionic extender, from about 10% to about 52% of organic solvent and from 0% to about 30% of water, wherein the cationic fabric softener, nonionic extender and organic solvent constitute in total at least about 70% of the concentrate.

8. A concentrate according to claim 1 comprising from about 20% to about 44% of cationic fabric softener, from about 3% to about 70% of nonionic extender, from about 10% to about 77% of organic solvent and from 0% to about 45% of water, wherein the cationic fabric softener, nonionic extender and organic solvent constitute in total at least about 55% of the concentrate.

* * * * *

UNITED STATES PATENT AND TRADEMARK OFFICE

CERTIFICATE OF CORRECTION

PATENT NO. : 4,454,049

DATED : June 12, 1984

INVENTOR(S) : N.A. MacGilp, A.C. McRitchie, B.T. Ingram and J. Hampton

It is certified that error appears in the above-identified patent and that said Letters Patent are hereby corrected as shown below:

Col. 6, lines 20-27, in formula III

"

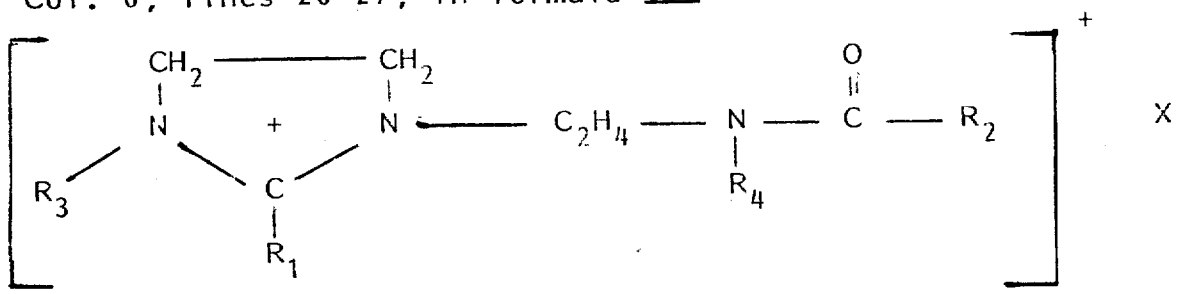

"

should read --

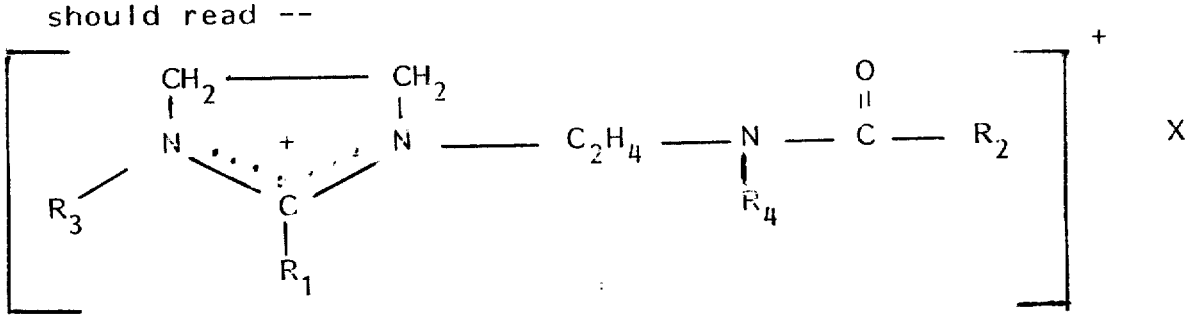

UNITED STATES PATENT AND TRADEMARK OFFICE

CERTIFICATE OF CORRECTION

PATENT NO. : 4,454,049

DATED : June 12, 1984

INVENTOR(S) : N.A. MacGilp, A.C. McRitchie, B.T. Ingram and J. Hampton

It is certified that error appears in the above-identified patent and that said Letters Patent are hereby corrected as shown below:

Col. 8, lines 7-16, in the formula:

"

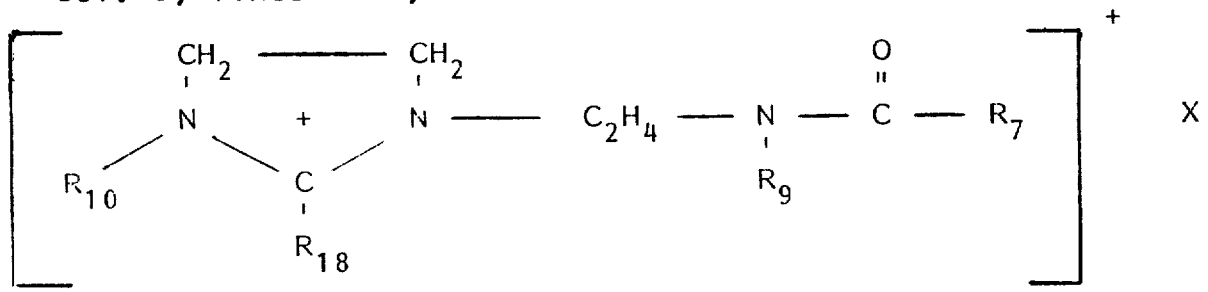

"

should read --

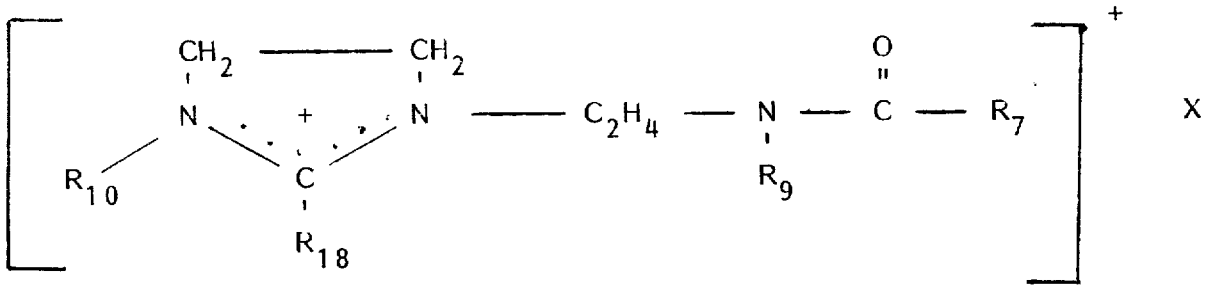

UNITED STATES PATENT AND TRADEMARK OFFICE

CERTIFICATE OF CORRECTION

PATENT NO. : 4,454,049

DATED : June 12, 1984

INVENTOR(S) : N.A. MacGilp, A.C. McRitchie, B.T. Ingram and J. Hampton

It is certified that error appears in the above-identified patent and that said Letters Patent are hereby corrected as shown below:

Col. 10, lines 60-67, in the formula:

"

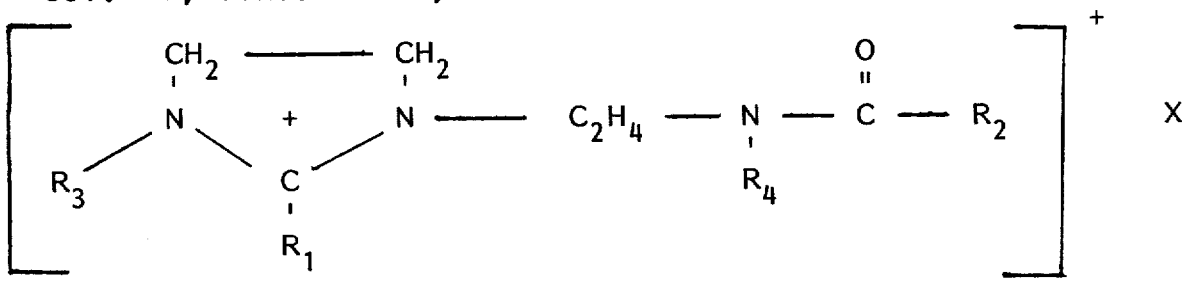

"

should read --

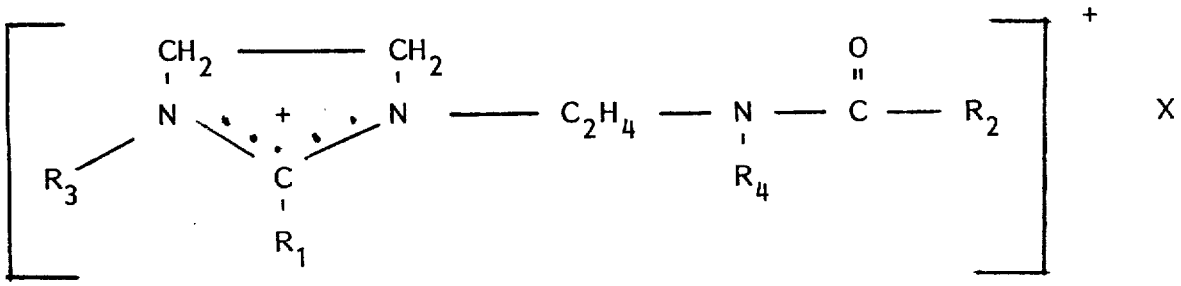

UNITED STATES PATENT AND TRADEMARK OFFICE

CERTIFICATE OF CORRECTION

PATENT NO. : 4,454,049

DATED : June 12, 1984

INVENTOR(S) : N.A. MacGilp, A. C. McRitchie, B. T. Ingram and J. Hampton

It is certified that error appears in the above-identified patent and that said Letters Patent are hereby corrected as shown below:

Col. 11, line 15, "claim 3" should read -- claim 2 --.

Signed and Sealed this

*Thirtieth* Day of *July 1985*

[SEAL]

*Attest:*

DONALD J. QUIGG

*Attesting Officer* *Acting Commissioner of Patents and Trademarks*